US009364104B1

(12) United States Patent
Wood et al.

(10) Patent No.: US 9,364,104 B1
(45) Date of Patent: Jun. 14, 2016

(54) COLLAPSING CLOTHING DISPLAY FIXTURE

(71) Applicant: Opto International, Inc., Wood Dale, IL (US)

(72) Inventors: Graham Robert Wood, Callawassie Island—Okatie, SC (US); Brett A. Woodley, Wilmette, IL (US); Erich Haller, Buffalo Grove, IL (US)

(73) Assignee: OPTO INTERNATIONAL, INC., Wood Dale, IL (US)

( * ) Notice: Subject to any disclaimer, the term of this patent is extended or adjusted under 35 U.S.C. 154(b) by 0 days.

(21) Appl. No.: 14/567,670

(22) Filed: Dec. 11, 2014

(51) Int. Cl.
*D06F 57/08* (2006.01)
*A47F 5/00* (2006.01)
*A47F 5/10* (2006.01)
(Continued)

(52) U.S. Cl.
CPC ..... *A47F 5/0081* (2013.01); *A47F 5/0006* (2013.01); *A47F 5/0037* (2013.01); *A47F 5/10* (2013.01); *A47F 5/101* (2013.01); *A47F 5/12* (2013.01); *A47G 25/06* (2013.01); *A47G 25/0664* (2013.01); *A47G 25/0685* (2013.01); *A47G 25/0692* (2013.01);
(Continued)

(58) Field of Classification Search
CPC ..... A47G 25/0664; A47G 25/0671; A47G 25/0692; A47G 25/06; A47G 25/0685; A47F 7/24; A47F 5/10; A47F 5/0006; A47F 5/0081; A47F 5/103; A47F 5/12; A47F 5/101; A47F 7/19; A47F 5/0037; A47B 45/00; A47B 61/003; A47B 96/14; A47B 47/00; A47B 47/02; A47B 47/03; A47B 47/05; D06F 57/08; D06F 57/00; D06F 57/06
USPC ..... 211/123, 195, 204, 206, 175, 85.24, 211/187, 189
See application file for complete search history.

(56) References Cited

U.S. PATENT DOCUMENTS 349,769 A * 9/1886 Udell ..... 211/204
490,380 A * 1/1893 Ward ..... 211/195
(Continued)

FOREIGN PATENT DOCUMENTS

CN 202 341 670 U 7/2012
DE 29617269 U1 * 12/1996
(Continued)

OTHER PUBLICATIONS

Communication from related EP application; EP 15177746.3-1653, dated Apr. 13, 2013 (7 pags.).

*Primary Examiner* — Brian Glessner
*Assistant Examiner* — Babajide Demuren
(74) *Attorney, Agent, or Firm* — Husch Blackwell LLP

(57) ABSTRACT

The subject invention comprises a collapsible display fixture that includes a base, two vertical support posts that can accept vertical display panels, a horizontal crossbar and hinge that connects each vertical support post to the base. The hinge may be one of two forms, either a hinge with an axis of rotation at an angle of 2-6 degrees, or preferably 3 degrees, or a hinge with a rotatable base that allows the hinge to be rotated 2-6 degrees, or preferably 3 degrees. These hinges allow the vertical support posts to be folded down without intersecting or contacting one another. The vertical display panels integrate an internal pin system, whether the panel is solid or a combination of two laminated layers, such that the pins are accessible from the outside to accept hangers, pins, pegs, hooks or other display accessories.

9 Claims, 10 Drawing Sheets

(51) Int. Cl.

| | |
|---|---|
| ***D06F 57/06*** | (2006.01) |
| ***A47G 25/06*** | (2006.01) |
| ***A47F 5/12*** | (2006.01) |
| *A47F 7/24* | (2006.01) |

(52) U.S. Cl.
CPC ..... *D06F 57/06* (2013.01); *D06F 57/08* (2013.01); *A47F 7/24* (2013.01)

(56) References Cited

U.S. PATENT DOCUMENTS

| | | | | |
|---|---|---|---|---|
| 2,920,767 | A * | 1/1960 | Halip | 211/175 |
| 3,044,840 | A * | 7/1962 | Hamilton | 108/125 |
| 3,146,892 | A | 9/1964 | White | |
| 3,197,035 | A * | 7/1965 | Wolf | 211/204 |
| 3,503,525 | A * | 3/1970 | Loebner | 211/206 |
| 3,918,591 | A * | 11/1975 | Cooper | 211/204 |
| 5,617,962 | A * | 4/1997 | Chen | 211/206 |
| 6,029,833 | A * | 2/2000 | Yeh | 211/189 |
| 6,102,216 | A | 8/2000 | Frank | |
| 6,401,948 | B1 * | 6/2002 | Huang | 211/206 |
| 6,659,021 | B2 * | 12/2003 | Wen | 108/125 |
| 6,991,118 | B2 | 1/2006 | Phillips | |
| 7,083,055 | B1 * | 8/2006 | Ambrosat | 211/85.7 |
| 7,946,434 | B1 * | 5/2011 | Greenspon | 211/85.3 |
| 8,172,099 | B1 | 5/2012 | Hardy | |
| 8,434,630 | B2 | 5/2013 | Clark et al. | |
| 2004/0129661 | A1 * | 7/2004 | Segall et al. | 211/206 |
| 2004/0262246 | A1 * | 12/2004 | Martins | 211/59.1 |
| 2005/0127018 | A1 * | 6/2005 | Sung | 211/206 |
| 2006/0118505 | A1 | 6/2006 | Walter | |
| 2007/0163974 | A1 * | 7/2007 | Lai | 211/85.3 |
| 2008/0029473 | A1 * | 2/2008 | Hu | 211/206 |
| 2008/0217269 | A1 * | 9/2008 | Topping et al. | 211/59.1 |
| 2009/0250422 | A1 * | 10/2009 | Clark et al. | 211/189 |
| 2012/0074082 | A1 * | 3/2012 | Hornsby | 211/85.3 |
| 2013/0284684 | A1 | 10/2013 | Stukenberg et al. | |
| 2015/0008201 | A1 * | 1/2015 | Qiang et al. | 211/85.3 |

FOREIGN PATENT DOCUMENTS

| | | | | |
|---|---|---|---|---|
| DE | 203 09 049 | U1 | 8/2003 | |
| DE | 202012101509 | U1 * | 7/2012 | |
| EP | 0 005 901 | | 12/1979 | |
| FR | 2658252 | A3 * | 8/1991 | A47F 5/08 |
| GB | 667 476 | A | 3/1952 | |
| GB | 2 171 598 | | 9/1986 | |
| JP | S 75753 | | 5/1987 | |
| JP | H08 24053 | A | 1/1996 | |

* cited by examiner

COLLAPSING CLOTHING DISPLAY FIXTURE

FIELD OF THE INVENTION

The Invention pertains to a collapsible display fixture for use in retail sales. More particularly, the invention pertains to a collapsing retail display fixture that allows the display to be folded down to reduce shipping and storage size, and allows for the attachment of shelves, hooks, pegs and other display accessories while retaining a high degree of stability and support.

Known display racks generally provide little or no collapsing capabilities, or do so using complicated, multi-part or multi-hinged mechanisms that are expensive, prone to failure or are difficult to use. Retail fixtures are often moved, stored, shipped and displayed in seasonal cycles. Furthermore, some retail contexts require such displays to be erected and removed on short notice, such as "pop-up" stores, or temporary locations. It is therefore desirable to have a fixture that is easily and quickly folded and stored, but retains stability and the ability to accept accessories common to standard, non-collapsing fixtures.

BACKGROUND OF THE INVENTION

Retail fixtures comprise large, bulky metal racks meant to support sale items and accept modular shelving, pegs, hooks and other display accessories. They are used in retail stores for the display of articles and accessories. Such retail stores are often being opened and closed, and even while in operation, regularly re-arrange the layout of the stores due to seasonal marketing cycles. However, storage and shipment of these large, bulky display fixtures costs retailers significant money, and can be prohibitive if they cannot be efficiently stored.

The simplest way to collapse such a fixture is to fold down any vertical components. However, because these fixtures are symmetrical, any vertical components are prone to collide when folded.

Existing display fixtures avoid this problem using complicated telescoping mechanisms, a multitude of hinges placed in the middle of various support members, or which come apart entirely. These solutions are not ideal because they either decrease the stability of the assembled fixture or result in loose pieces which are easily lost.

Accordingly, there is a need for a retail display fixture that can be easily moved and stored, while retaining the ability to accept accessory display attachments such as shelves, hooks, pegs and other similar methods of displaying merchandise.

Thus, a benefit of the subject invention is a collapsing retail fixture that allows the fixture to be quickly and easily collapsed for more efficient storage than a non-collapsing fixture.

A further benefit of the subject invention is a hinge for such collapsing retail fixtures that allows the vertical support members to fold down such that they do not collide with one another. This allows the fixture to collapse more efficiently and retain the integrity of the support racks by avoiding the addition of hinges or clasps or telescoping elements to the supports which can impact the stability of the supports.

A still further benefit of the subject invention is a vertical structure for the ends of the fixture containing an integrated peg system, allowing for the attachment of shelves, peg hooks and other retail display accessories.

SUMMARY OF THE INVENTION

The subject invention comprises a collapsible retail display fixture that includes vertical support posts attached to the base using angled hinges or rotating hinges such that the support posts may be folded down without intersecting or contacting one another. These vertical support posts support a horizontal cross bar and vertical display panels using an integrated peg system used to attach shelves, hooks, pegs and other display accessories. The fixture also includes a horizontal crossbar for hanging clothes and other retail items.

CONCISE DESCRIPTION OF THE DRAWINGS

These and other benefits, features and advantages of the present invention will become apparent to those skilled in the art from the following description and accompanying figures illustrating the preferred embodiment of the subject invention.

Figure 14A:
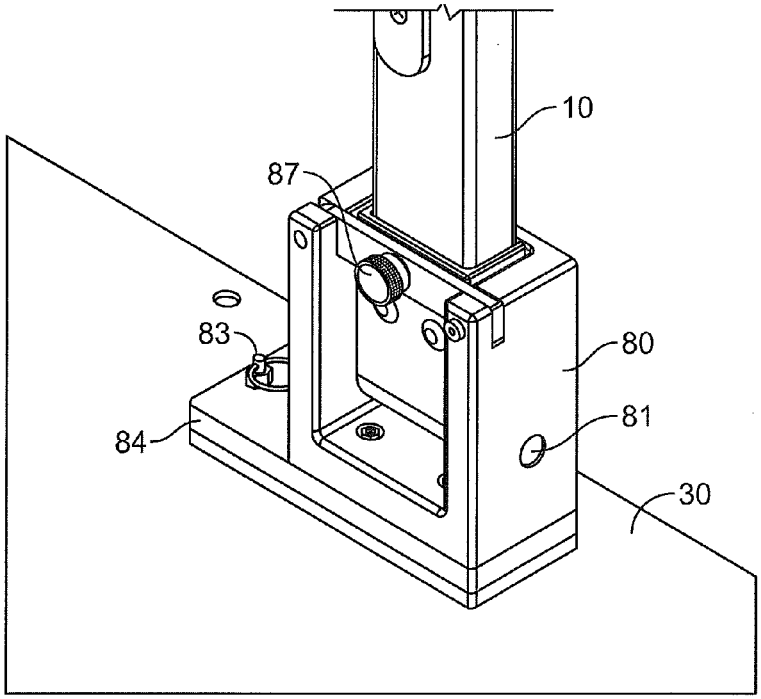

FIG. 14*a* is an external view of the second embodiment of the hinge, showing the hinge in the position used for the fixture in its upright and assembled format.

Figure 14B:
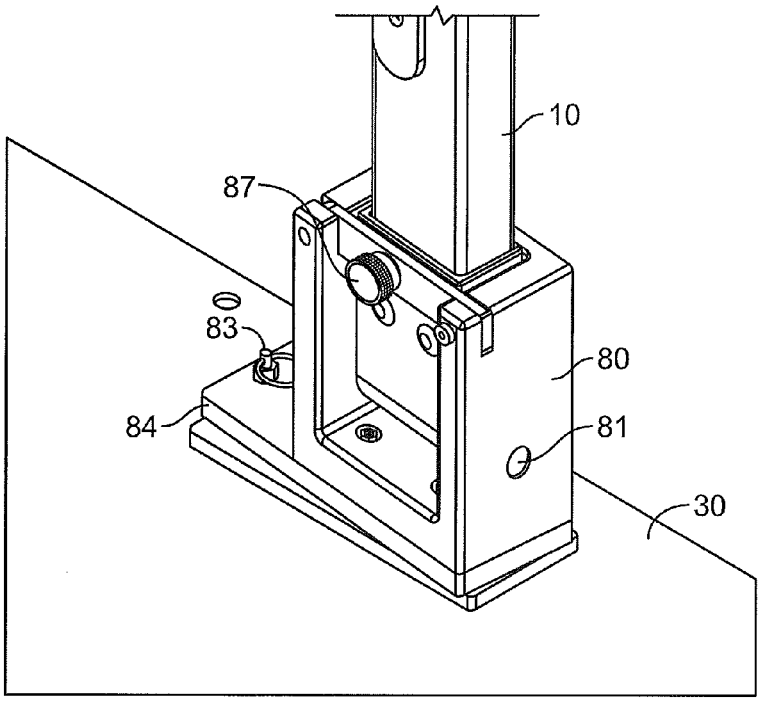

FIG. 14*b* is an external view of the second hinge embodiment, showing the hinge in its rotated position, allowing the vertical display posts to fold down without colliding.

Figure 15:
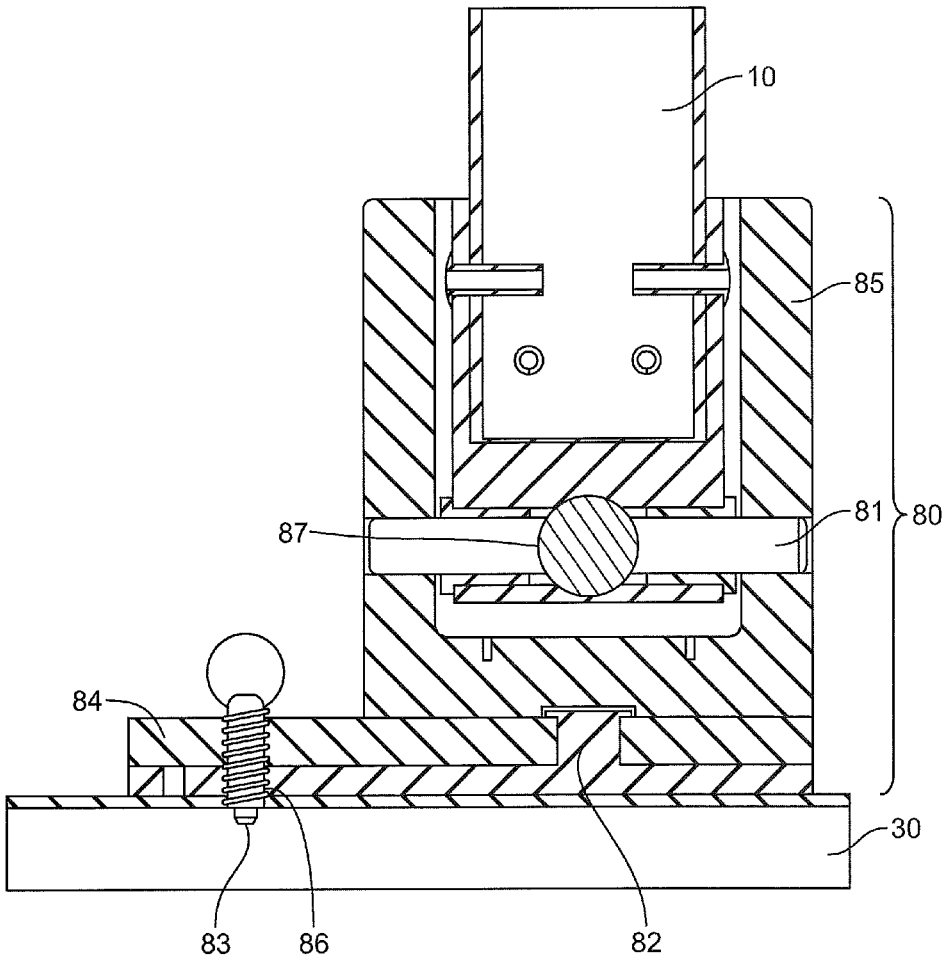

FIG. 15 is a cross section of the second, rotating embodiment of the hinge. In this embodiment, the entire hinge assembly rotates in order to allow the vertical support posts to fold down without colliding.

Figure 16:
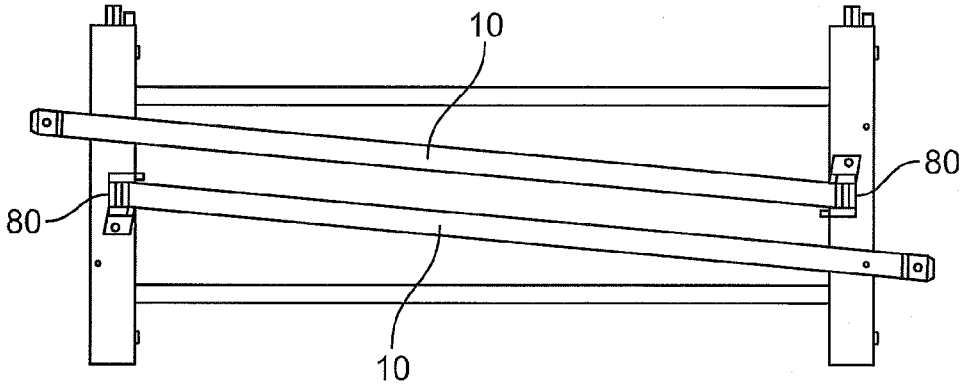

FIG. 16 is a top view of the invention with the vertical display posts folded down using the second embedment of the hinge, rotated as shown in FIG. 15.

Figure 17:
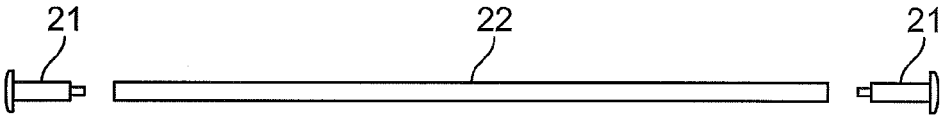

FIG. 17 is a view of the three components of the crossbar, the central segment and the two endcaps.

Figure 18:
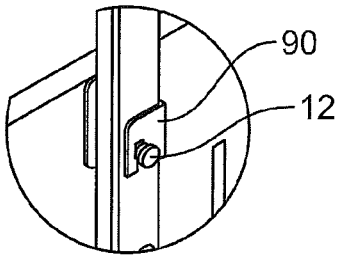

FIG. 18 is a view of the mounting bracket of the vertical display panel engaged with the hanging pin of the vertical support posts.

Figure 19:
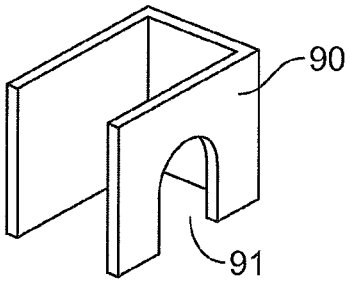

FIG. 19 is a view of the mounting bracket showing the notch designed to engage with the hanging pin of the vertical support posts.

Figure 20:
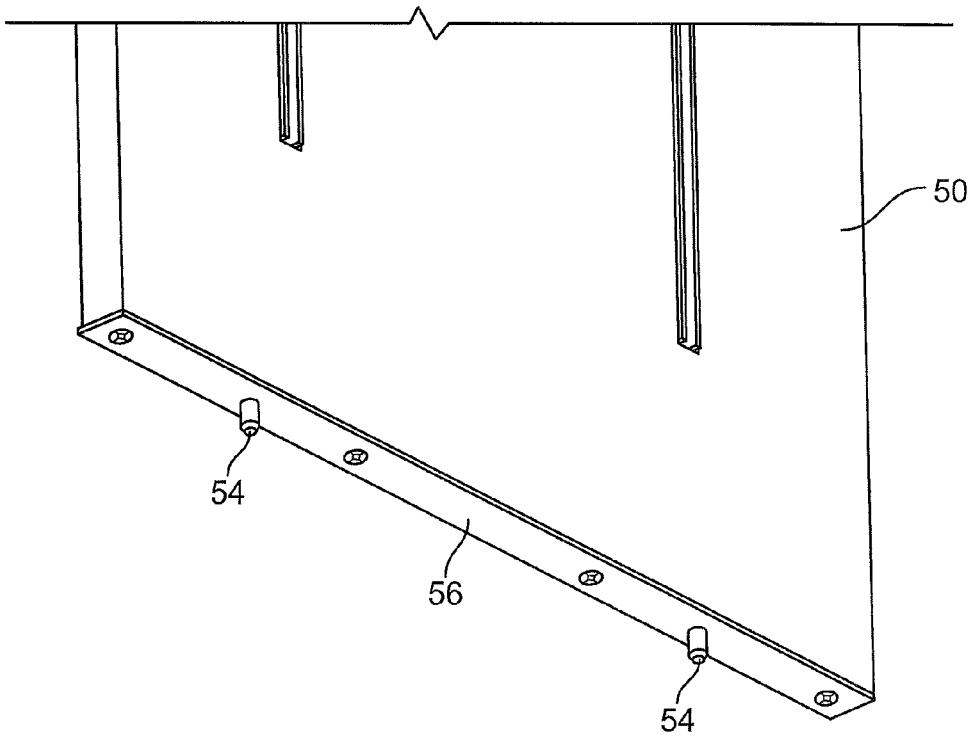

FIG. 20 is a view of the bottom edge of the vertical display panels, showing the retention pins that anchor into holes in the base of the display fixture.

DETAILED DESCRIPTION OF THE INVENTION

Figure 1:
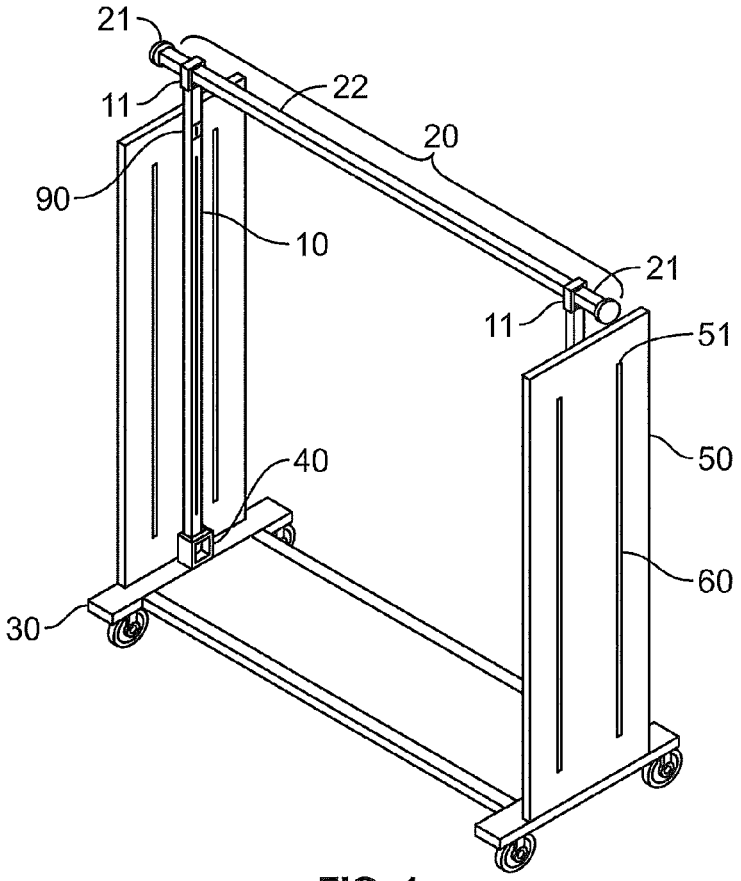
FIG. 1 is a perspective view of the invention with angled hinges anchoring the vertical support posts showing the vertical support posts, horizontal crossbar, base and casters.
Figure 2:
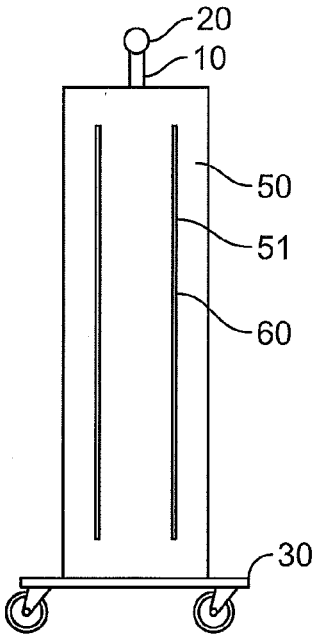
FIG. 2 is a side view of the invention showing the vertical display panels with integrated peg system.
Figure 3:
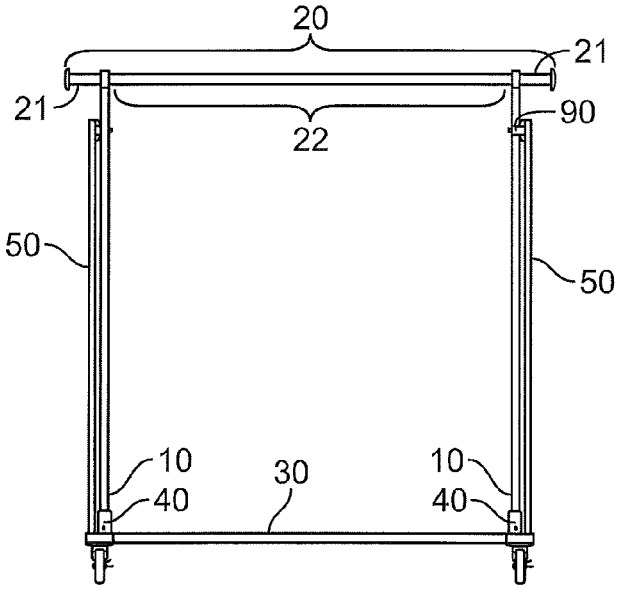
FIG. 3 is a front view of the invention showing the vertical support posts, horizontal crossbar, and base.
Figure 13:
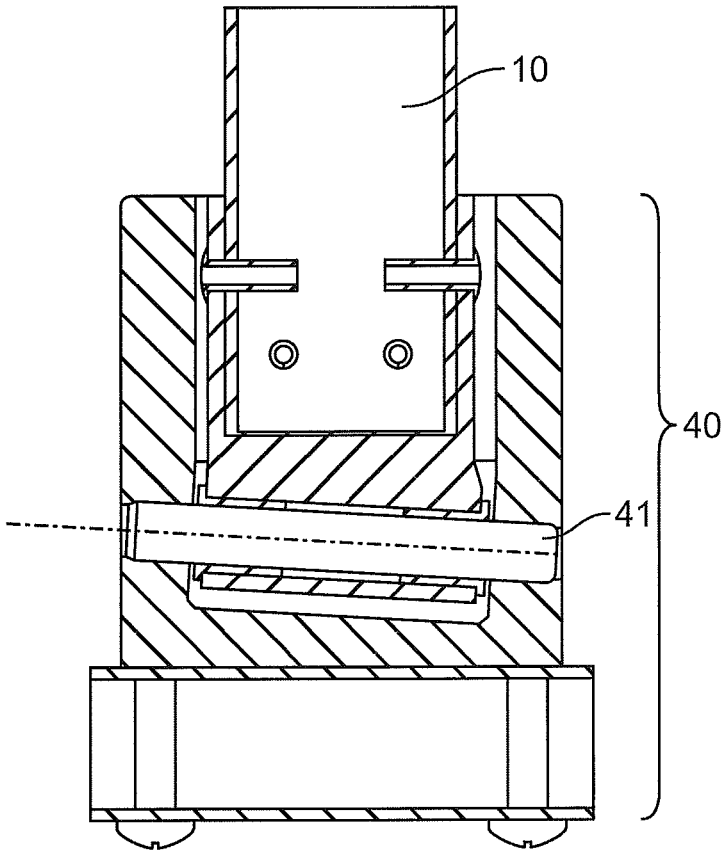
FIG. 13 is a cross sectional view of the angled hinge showing the 2-6 degree angle of the hinge's axis of rotation.

Referring to FIGS. 1 and 2, there is shown vertical support posts 10 supporting a horizontal crossbar 20. The vertical support posts 10 are pivotally anchored to the base 30 using hinges 40 that are either immovably fixed to the base 30 (See FIG. 13) and have axes of rotation 41 at an angle of 2-6 degrees to the plane of the base 30 or in a second embodiment, rotatably affixed to the base 30 (See FIG. 15). Removably attached to the vertical support posts 10 are vertical display panels 50 with vertical slots 51 cut into the vertical display panels providing access to the internal peg system 60. This vertical display panel 50 may be either a solid piece of material, or a laminated structure. When the vertical support posts 10 are folded down, they rest upon the top of the base 30 and are parallel to the plane of said base 30 but do not intersect with or contact one another.

Figure 11:
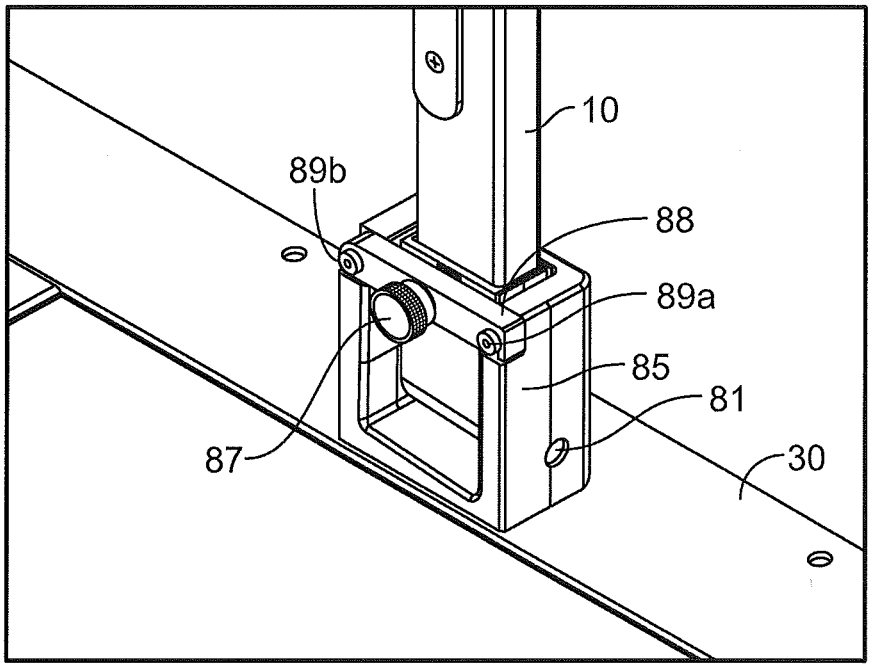
FIG. 11 is a perspective view of the fixed hinge showing the closed retention lever and the tightening knob tightened.

When the vertical support posts 10 are in the vertical position, see FIG. 11, a retention lever 88 with a first end 89*b* is rotatably affixed to a first side of the hinge 85 and a second end that engages with a latching pin 89*a* attached to a second side of the hinge 85. Located substantially in the middle of the retention lever 88 is a tightening knob 87 which by means of a threaded screw body extending through the retention lever 88 can be rotated to engage with the vertical display post 10 in order to increase stability while vertical.

Figure 12:
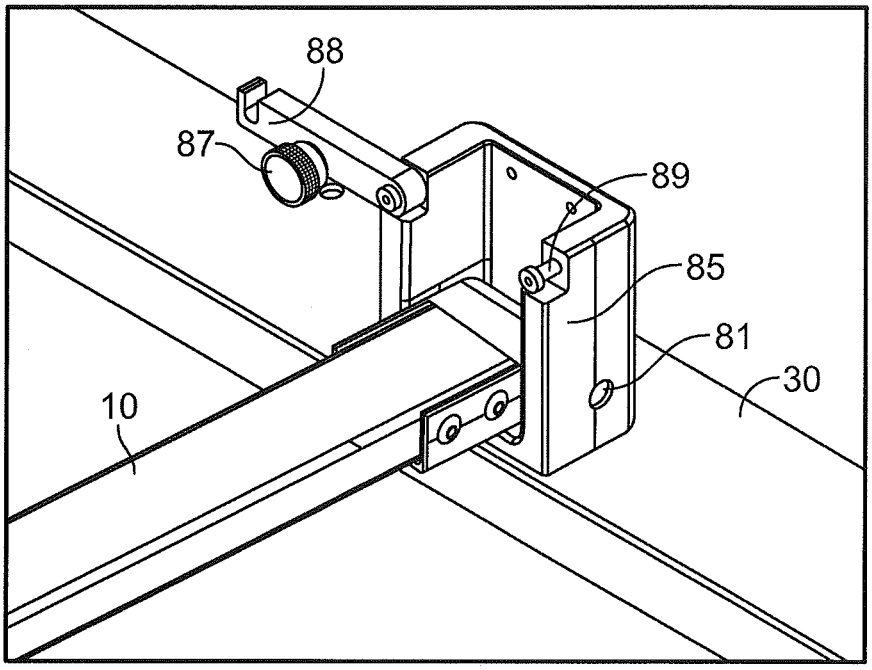
FIG. 12 is a perspective view of the fixed hinge showing the open retention lever and the tightening knob retracted.

When the vertical support posts 10 are in the lowered position, see FIG. 12, the tightening knob 87 can be loosened to disengage it from the vertical display post 10, and the retention lever 88 may be rotated out of the way. While the vertical support posts 10 are in the collapsed position, the retention lever may either be left in the closed position, see FIG. 11, or in the open position, see FIG. 12.

The crossbar 20 in FIG. 1 spans the distance from one vertical support post 10 to the other vertical support post 10.

Figure 4:
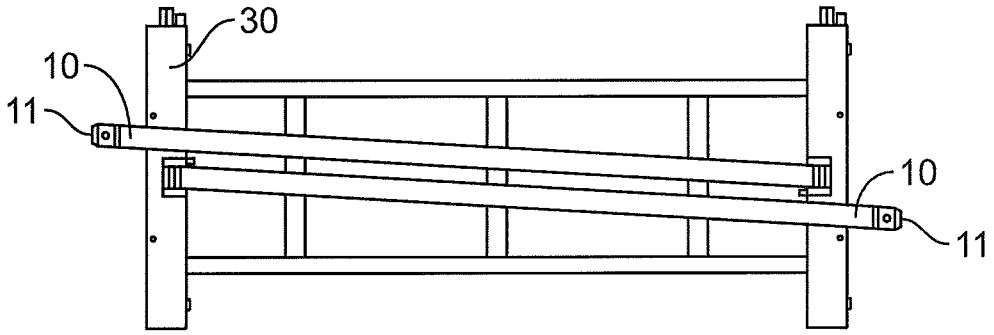
FIG. 4 is a top view of the collapsed invention, using the angled hinges such that the vertical support posts do not collide when folded down.
Figure 5:
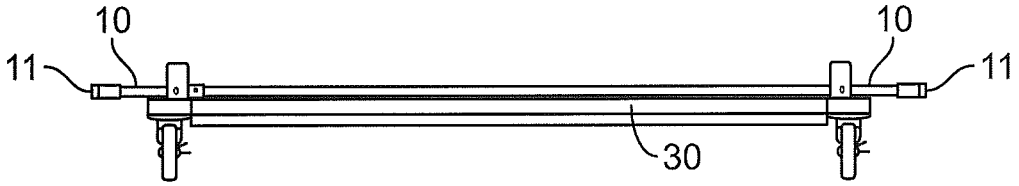
FIG. 5 is a side view of the collapsed invention.

Referring to FIG. 4, the vertical support posts 10, can be collapsed to save space during storage or shipping. In one embodiment of the invention, the hinge 40 is immovably affixed to the base 30. This hinge 40 has an axis of rotation 41, see FIG. 13, set at a 2-6 degree angle, and preferably a 3 degree angle, to the horizontal such that when the vertical support posts 10 are folded down, they do so such that they do not collide or otherwise make contact. See FIGS. 4 and 13.

In an alternative embodiment of the invention, shown in FIGS. 15, 14*a* and 14*b*, the hinge 80 rotates such that when the vertical support posts 10 are folded down, they do not collide or otherwise make contact. See FIG. 16. In this embodiment, the axis of rotation 81, see FIGS. 14*b* and 16, about which the vertical support posts 10 rotate into a collapsed position in a plane parallel to fixture's base 30. See FIGS. 14*b* and 16. The hinge 80 is attached to the base 30 around a central vertical axis 82 around which the hinge 80 and attached vertical support post 10 rotate. The portion of the hinge 80 which makes contact to the base 30 and through which the vertical axis 82 anchors, here referred to as the hinge base 84, extends by a greater amount to one side of the hinge body 85, and has integrated a retractable spring plunger 83. The retractable spring plunger 83 may be actuated from above the hinge base 84 such that it may be raised and lowered. In the lowered position, the retractable spring plunger 83 extends through the hinge base 84 and partially into the base 30 into one of two engagement holes 86. The hinge 80 and attached vertical display post 10 may be rotated only when the retractable spring plunger 83 is lifted, and may not be rotated when the retractable spring plunger is deposited into one of the two engagement holes 86.

These engagement holes 86 are positioned such that if the retractable spring plunger 83 is placed into the first engagement hole 86, the vertical support post 10 attached thereto would fold down directly towards the other and collide. When the vertical display posts 10 are in the vertical position, the invention would be used for displaying merchandise, and allows for the proper attachment of the crossbar 20. The hinge 80 may be rotated 4-6 degrees, and in a preferred embodiment, 5 degrees, when the retractable spring plunger 83 is lifted, such that the retractable spring plunger 83 may be deposited in the second engagement hole 86. In this position, the vertical display posts 10 may be rotated downwards so that they are parallel to one another and in a parallel plane above the plane of the base 30. They do not collide, however, because the rotation of said hinges 80 causes the folded vertical display posts 10 to also rotate the same amount. See FIG. 16.

The vertical support posts 10 support the vertical display panels 50. The bottom edge of the vertical display panel 50 bears one or more anchor posts 54. These anchor posts 54 engage into corresponding holes in the fixture base 30 in order to anchor the bottom edge 55 of the vertical display panels 50 to the fixture base 30.

These vertical display panels have vertical bracket channels 51 that allow external access to the internal peg support system 60. These vertical support panels may be in one of at least two embodiments.

Figure 6:
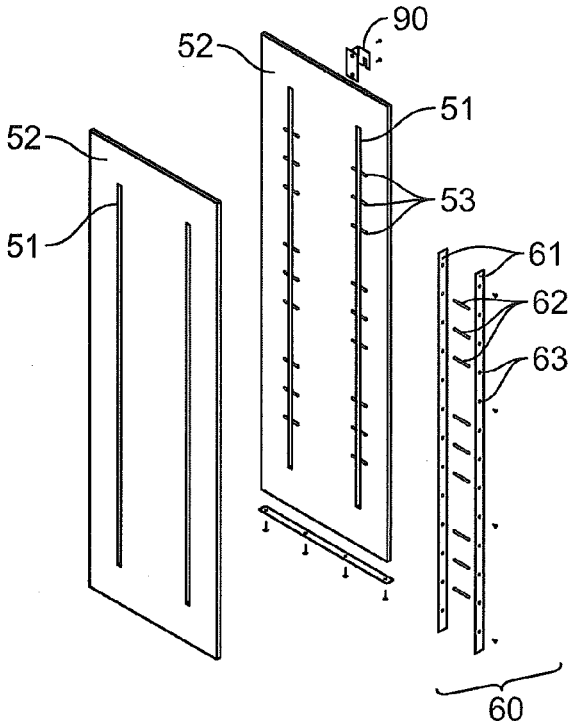
FIG. 6 is an exploded view of a laminated style vertical display panel showing the internal peg-ladder support system, and the grooves cut into the display panel to accept this support system.
Figure 7:
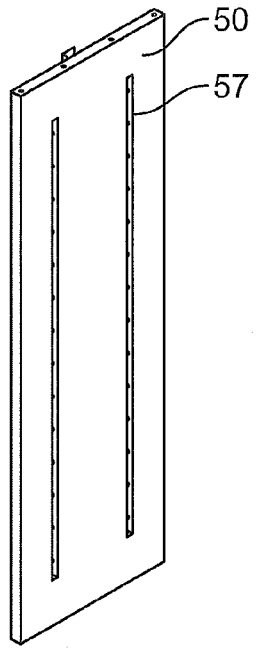
FIG. 7 is a front view of a single-pane style vertical display panel showing the integrated peg support system and the slot cut into the panel to accept this system.
Figure 8:
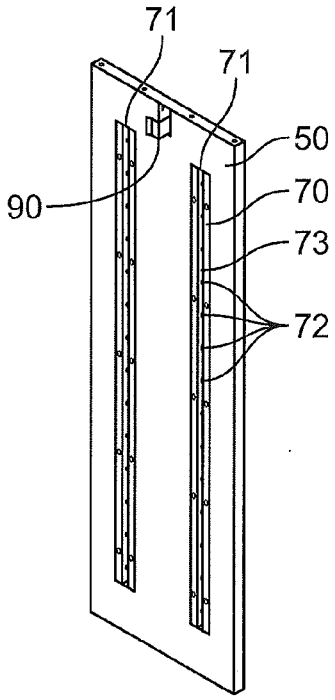
FIG. 8 is a back view of a single-pane style vertical display panel showing the integrated peg support system and the slot cut into the panel to accept this system.

In the first embodiment shown in FIG. 6, the panel 50 may be a laminated combination of two layer-panels 52 that allow the peg system 60 to be located completely within the vertical display panel 50. The vertical display panels 50 have vertical channels 51 cut into the panels allowing access to the internal peg system 60. In this embodiment, the peg system 60 consists of two vertical connecting plates 61. These vertical connecting plates 60 have periodically spaced holes 63. The pegs 62, which share a substantially similar circumference as the holes 63 in the vertical connecting plates 60 are inserted into the holes 63 in two vertical connecting plates 60 and extend an equal distance on either side of these plates creating a ladder-like structure. The distance between the vertical connecting plates 61 is the same as the width of the vertical channels 51 cut into the vertical layer-panels 52. Perpendicular to the vertical channels 51 are horizontal channels 53 that allow the insertion of the pegs 62 such that when the two layer-panels 52 are pressed together, the pegs 62 reside inside these channels 53, the vertical connecting plates reside in the vertical channel 51 such that the layer-panels 52 are pressed together with no space in between, and the peg system 60 is accessible from the exterior.

In a second embodiment, the vertical display panels 50 may be a solid piece of material with a vertical channel 57 cut through the panel 50 allowing access to the integrated pin system 70. This integrated pin system consists of a vertical support bracket 71 and internal pins 72. The vertical support bracket consists of a long piece of metal with a square bend 73 in it that fits snugly within the vertical channel 57 in the vertical display panel 50. Within this square bend 73 are periodic pins 72 that are wholly contained within the square bend 73 and are positioned perpendicular to the path of the square bend 73 and parallel to the base 30.

Figure 9:
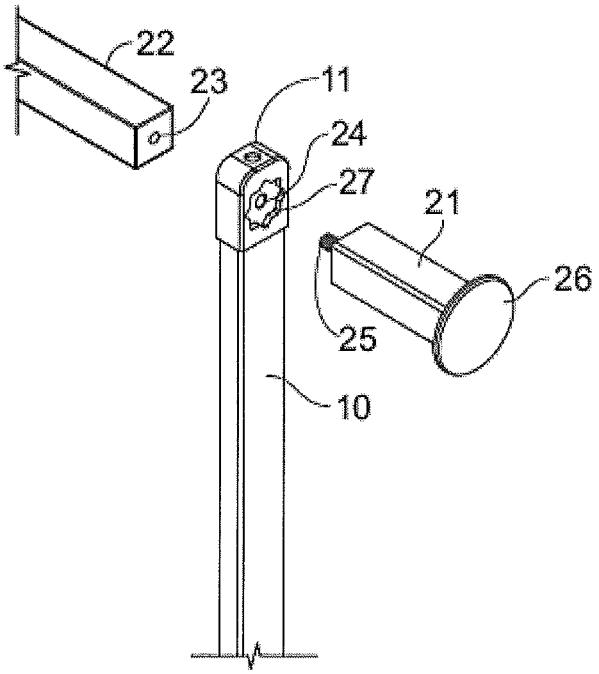
FIG. 9 is a view of the cross bar and its attachment to the vertical display posts, and the endcaps that keep the crossbar in place.
Figure 10:
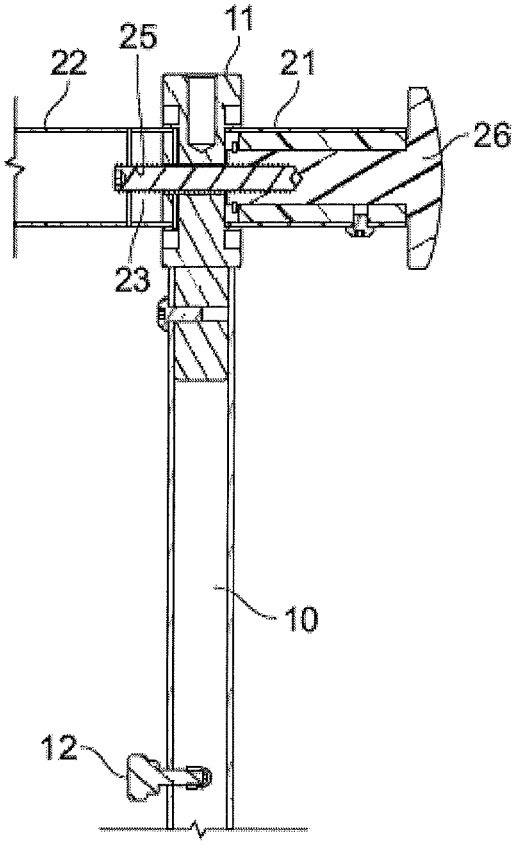
FIG. 10 is a cross section of the cross bar and its attachment to the vertical display posts, and the endcaps that keep the crossbar in place.

The crossbar 20 consists of three components: the central segment 22 and two endcaps 21. See FIG. 17. Referring to FIGS. 9 and 10, the central segment 22 is substantially the same length as the distance between the two vertical display posts 10. Each end 21 of the central segment 20 has an opening in the center providing access to a threaded tunnel 23 sharing a central axis with the central segment 22. The endcap 21 has a cap 26 on the first end and a threaded bolt body 25 extending from its immovable attachment to the interior face of the cap 26 to substantially past the end of the body of the endcap 21. The vertical support post 10 has a head 11 on the end opposite the hinge, 40 or 80, containing a substantially round passage 24 through which the threaded bolt body 25 may pass. This passage 24 is located in the center of indentations on either side of the head 11 that reflect the shape of the central segment 22 and endcap 21, which are identical. This indentation allows the central segment and endcap 21 to fit securely within these indentations 27 such that once inserted neither the central segment nor the endcap can be rotated.

The crossbar 20 may be assembled as part of the invention as follows. See FIGS. 9 and 10. The central segment 22 is engaged to the head 11 of the vertical support post 10 such that the threaded tunnel 23 aligns with the passage 24 in the head 11 of the vertical support post 10. The endcap 21 is then engaged to the head 11 of the vertical support post 10 such that the threaded bolt body 25 passes through the passage 24 and into the corresponding threaded tunnel 23. The cap 26, which is attached immovably to the threaded bolt body 25 may then be rotated in order to engage the threaded bolt body 25 with the corresponding threaded tunnel 23, securing the endcap 21, the head 11 and vertical support post 10 to the central segment 22.

A first embodiment of the crossbar, including the central segment 22 and endcaps 21, has a substantially square cross-section. The central segment 22 and endcaps 21 may be engaged with the head 11 of the vertical support posts 10 in one of two modes. The first mode is in which a corner edge of the central segment 22 and endcaps 21 is facing upwards, while in the second mode, the entirety of the crossbar 10 is rotated 45 degrees such that a flat edge of the central segment 22 and endcaps 21 is facing upward.

A second embodiment of the crossbar, including the central segment 22 and endcaps 21, has a substantially round cross-section. Though this round cross-section differs from the first embodiment described above, no new head 11 for the vertical support posts 10, is required.

The vertical display panels 50 are attached to the vertical support posts 10 using a mounting bracket 90. See FIGS. 1 and 18. The mounting bracket 90 is attached to the back of the vertical display panel 50 near the top and centered. The mounting bracket 90 comprises a single piece of substantially rectangular material, preferably metal or plastic that support the weight of the vertical display panel 50, with dimensions substantially three times as long as high. This material has two right-angle bends creating a c-shaped bracket 90. The interior area of this bracket after bends are added is substantially the same as the cross sectional area of the vertical support posts 10. One end of this bracket 90 contains a notch 91 the mouth of said notch opening on one of the long sides of the bracket 90.

The vertical display panel 50, bearing mounting bracket 90, is attached to the vertical display posts 10 by inserting the vertical display post 10 into the opening of the bracket 90. The opening 91 in the bracket 90 is then lowered onto the hanging peg 12 on the face of the vertical display post 10 that faces the opposing vertical display post 10. This allows the vertical display panel 50 to hang securely and substantially upright and substantially parallel to the vertical display post 10.

It will be understood that the forgoing description is of preferred exemplary embodiments of the invention and that the invention is not limited to the specific forms shown or described herein. Various modifications may be made in the design, arrangement, and type of elements disclosed herein, as well as the steps of making and using the invention without departing from the scope of the invention as expressed in the appended claims.

We claim:

1. A fixture comprising two vertical support posts, and two horizontal bases spaced a distance from each other, each vertical support post having a bottom end attached to one of the respective horizontal bases, and a top end for supporting a horizontal crossbar;

said vertical support posts being each vertically pivotal to be movable from a first upright position to a second horizontal position substantially parallel to said horizontal base;

said vertical support posts being horizontally pivotal to be movable from a first horizontal position to the second horizontal position;

said vertical support posts bearing a vertical display panel when in the first upright position;

the vertical display panel comprising a vertical panel with a vertical groove cut into it with a pin system attached to a back of said vertical display panel, the pin system having pins accessible from the front through the vertical groove;

said vertical support posts being substantially perpendicular to the base to which they are attached when in said first upright position and substantially parallel and coplanar to the base to which they are attached when in said second horizontal position and a distal end of each of said vertical support posts extending beyond the bases.

2. A fixture comprising two vertical support posts each having a first top end for supporting a horizontal crossbar and a second bottom end pivotally attached to a base for horizontal rotation between 2 and 6 degrees from the longitudinal axis of the base and allowing the vertical support posts to vertically pivot down from a vertical position to a horizontal position without intersecting or making contact, the vertical support posts supporting laminated display panels with a vertical channel exposing an interior peg channel.

3. The fixture of claim 1 wherein the vertical display panel comprises a pair of substantially rectangular laminated layer-panels with a vertical channel exposing an interior peg system.

4. The fixture of claim 3 wherein the interior peg system has a first and second identical vertical connecting plate each pierced periodically by pegs extending equal distance to each side of the vertical connecting plates.

5. The fixture of claim 3 wherein said layer-panels have a vertical channel extending from near the top of the panel to near the bottom, containing first and second identical vertical connecting plate each pierced periodically by pegs extending equal distance to each side of the vertical connecting plates.

6. The fixture of claim 4 wherein each panel comprises a vertical substantially rectangular panel with a major groove cut into it substantially the length of the pane, with periodic minor groves cut perpendicularly to the major groove shaped to accept the pegs.

7. The fixture of claim 6 wherein the peg system comprises a vertical support bracket with a square bend down its axis containing pins affixed to the interior of said bend and oriented substantially perpendicular to the length of said support member.

8. The fixture of claim 6 wherein the vertical display panel comprises a vertical, substantially rectangular panel with a major groove cut into it substantially the length of the panel.

9. The fixture of claim 6 wherein the bottom edge of the vertical display panel contains one or more retention pegs extending from the bottom of the panel and which engage complementary holes in the fixture base in order to secure said panels.

* * * * *